US012108921B2

(12) United States Patent
Mobarak et al.

(10) Patent No.: US 12,108,921 B2
(45) Date of Patent: Oct. 8, 2024

(54) VACUUM CLEANER

(71) Applicant: MILWAUKEE ELECTRIC TOOL CORPORATION, Brookfield, WI (US)

(72) Inventors: David Mobarak, Germantown, WI (US); Justin D. Dorman, Wauwatosa, WI (US); Tauhira Hoossainy, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 1500 days.

(21) Appl. No.: 16/151,392

(22) Filed: Oct. 4, 2018

(65) Prior Publication Data

US 2019/0110650 A1 Apr. 18, 2019

Related U.S. Application Data

(60) Provisional application No. 62/572,220, filed on Oct. 13, 2017.

(51) Int. Cl.
*A47L 5/36* (2006.01)
*A45F 3/00* (2006.01)
(Continued)

(52) U.S. Cl.
CPC ..... *A47L 5/365* (2013.01); *A45F 3/14* (2013.01); *A47L 5/225* (2013.01); *A47L 5/36* (2013.01);
(Continued)

(58) Field of Classification Search
CPC . A47L 5/365; A47L 5/225; A47L 5/36; A47L 7/009; A47L 9/009; A47L 9/0063;
(Continued)

(56) References Cited

U.S. PATENT DOCUMENTS 3,286,446 A 11/1966 Happe et al.
5,267,371 A * 12/1993 Soler ..... A47L 9/1633 15/327.5
(Continued)

FOREIGN PATENT DOCUMENTS

CN 201641880 U 11/2010
CN 106923740 A 7/2017
(Continued)

OTHER PUBLICATIONS

Abstract of GB-466473-A (Year: 2021).*
(Continued)

*Primary Examiner* — Edward F Landrum
*Assistant Examiner* — Sarah Akyaa Fordjour
(74) *Attorney, Agent, or Firm* — Michael Best & Friedrich LLP

(57) ABSTRACT

A vacuum cleaner includes a vacuum body assembly. The vacuum body assembly includes a housing having a base end, a mount hook connected to the housing, a debris container removably coupled to the housing, and a suction source. The suction source is able to draw air into the debris container. A harness assembly is removably connected to the vacuum body assembly. The vacuum cleaner is convertible between a carry mode, a stand mode, and a hang mode. The harness assembly is connected to the vacuum body assembly in the carry mode, and the harness assembly is to be worn by a user. The base end of the vacuum body assembly may rest on a support surface in the stand mode. The hook of the vacuum body assembly may hang the body assembly from a mount structure in the hang mode.

17 Claims, 10 Drawing Sheets

(51) Int. Cl.

| | |
|---|---|
| ***A45F 3/14*** | (2006.01) |
| ***A47L 5/22*** | (2006.01) |
| ***A47L 9/00*** | (2006.01) |
| ***A47L 9/16*** | (2006.01) |
| ***A47L 9/28*** | (2006.01) |

(52) U.S. Cl.
CPC ..... *A47L 9/0018* (2013.01); *A47L 9/1666* (2013.01); *A47L 9/1683* (2013.01); *A47L 9/1691* (2013.01); *A47L 9/2884* (2013.01); *A45F 2003/003* (2013.01); *A45F 2003/146* (2013.01)

(58) Field of Classification Search
CPC .... A45F 2003/146; A45F 3/01; A41L 9/0009; Y10T 292/096; Y10T 292/0986; Y10T 292/0969; Y10T 292/097; Y10T 292/0977; Y10S 292/63
USPC ..... 15/327.5; 224/584, 585, 576, 637
See application file for complete search history.

(56) References Cited

U.S. PATENT DOCUMENTS

| | | | | |
|---|---|---|---|---|
| 5,732,867 | A | 3/1998 | Perkins et al. | |
| 6,295,692 | B1 * | 10/2001 | Shideler | A47L 5/36 15/327.5 |
| 6,557,206 | B1 | 5/2003 | Liu | |
| 7,287,300 | B2 | 10/2007 | Rupp et al. | |
| 7,721,384 | B2 | 5/2010 | Crevling, Jr. et al. | |
| 7,841,632 | B2 * | 11/2010 | Tracy | F16F 15/08 292/163 |
| 7,979,953 | B2 * | 7/2011 | Yoo | A47L 5/32 15/334 |
| 8,181,833 | B2 | 5/2012 | Wangeby et al. | |
| 8,312,591 | B1 * | 11/2012 | Wolfe, Jr. | A47L 9/0063 15/323 |
| 9,259,126 | B2 | 2/2016 | Niederman | |
| 9,486,120 | B2 | 11/2016 | Day | |
| 9,675,219 | B1 | 6/2017 | Chaffin | |
| 11,013,379 | B2 * | 5/2021 | Duong | A47L 5/36 |
| 2003/0101534 | A1 * | 6/2003 | Noreen | A47L 9/327 15/327.2 |
| 2007/0292749 | A1 | 12/2007 | Coombs et al. | |
| 2013/0047367 | A1 * | 2/2013 | Patrono | A47L 5/365 15/300.1 |
| 2015/0041512 | A1 * | 2/2015 | Rief | H01M 50/256 224/633 |
| 2015/0113759 | A1 | 4/2015 | Fukunaga et al. | |
| 2017/0007085 | A1 | 1/2017 | Tahara | |

FOREIGN PATENT DOCUMENTS

| | | | | | |
|---|---|---|---|---|---|
| CN | 106923741 | A | | 7/2017 | |
| DE | 202004005931 | U1 | | 6/2004 | |
| GB | 466473 | A | * | 5/1937 | A47L 9/00 |
| JP | H01642023 | A | * | 10/1992 | |
| JP | H06142023 | A | * | 5/1994 | |
| JP | 2017018567 | A | | 1/2017 | |

OTHER PUBLICATIONS

Machine Translation of JPH01642023A (Year: 2022).*
Translation of JPH06142023A (Year: 2024).*
International Search Report and Written Opinion for Application No. PCT/US2018/054279 dated Jan. 31, 2019, 12 pages.
Partial Supplementary European Search Report for Application No. 18866156.5 dated May 20, 2021 (17 pages).
European Patent Office Extended Search Report for Application No. 18866156.5 dated Aug. 20, 2021 (16 pages).
European Patent Office Action for Application No. 18866156.5 dated Jun. 29, 2023 (6 pages).

* cited by examiner

VACUUM CLEANER

CROSS-REFERENCE TO RELATED APPLICATIONS

This application claims priority to U.S. Provisional Patent Application No. 62/572,220, filed on Oct. 13, 2017, the entire contents of which are hereby incorporated by reference herein.

BACKGROUND

The present disclosure relates to vacuum cleaners. More particularly, the present disclosure relates to vacuum cleaners capable of being carried by a user.

SUMMARY

In one embodiment, the disclosure provides a vacuum cleaner. The vacuum cleaner includes a vacuum body assembly. The vacuum body assembly includes a housing having a base end, a mount hook connected to the housing, a debris container removably coupled to the housing, and a suction source. The suction source is able to draw air into the debris container. A harness assembly is removably connected to the vacuum body assembly. The vacuum cleaner is convertible between a carry mode, a stand mode, and a hang mode. The harness assembly is connected to the vacuum body assembly in the carry mode, and the harness assembly is to be worn by a user. The base end of the vacuum body assembly may rest on a support surface in the stand mode. The hook of the vacuum body assembly may hang the body assembly from a mount structure in the hang mode.

In another embodiment, the disclosure provides a vacuum cleaner having a vacuum body assembly. The vacuum body assembly includes a housing, a mount hook connected to the housing, a debris container removably coupled to the housing, and a suction source. The mount hook may hang the vacuum body assembly from a mount structure. The suction source may draw air into the debris container. A harness assembly is removably connected to the vacuum body assembly. The mount hook is positioned between the vacuum body assembly and the harness assembly such that the mount hook is at least partially concealed by the harness assembly. Removing the harness assembly from the vacuum body assembly at least partially reveals the mount hook.

In yet another embodiment, the disclosure provides a vacuum cleaner having a vacuum body assembly. The vacuum body assembly includes a housing, a debris container removably coupled to the housing, and a suction source. The suction source may draw air into the debris container. A harness assembly is removably connected to the vacuum body assembly. The harness assembly includes a base plate, at least one shoulder strap connected to the base plate, and a fastener rigidly connected to the base plate. The fastener has a shaft section and a lock section. A lock mechanism is connected to the housing of the vacuum body assembly. The lock mechanism may releasably lock the vacuum body assembly to the harness assembly. The lock mechanism is actuatable from a lock position to an unlock position. The lock mechanism traps the lock section of the fastener in the lock position.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
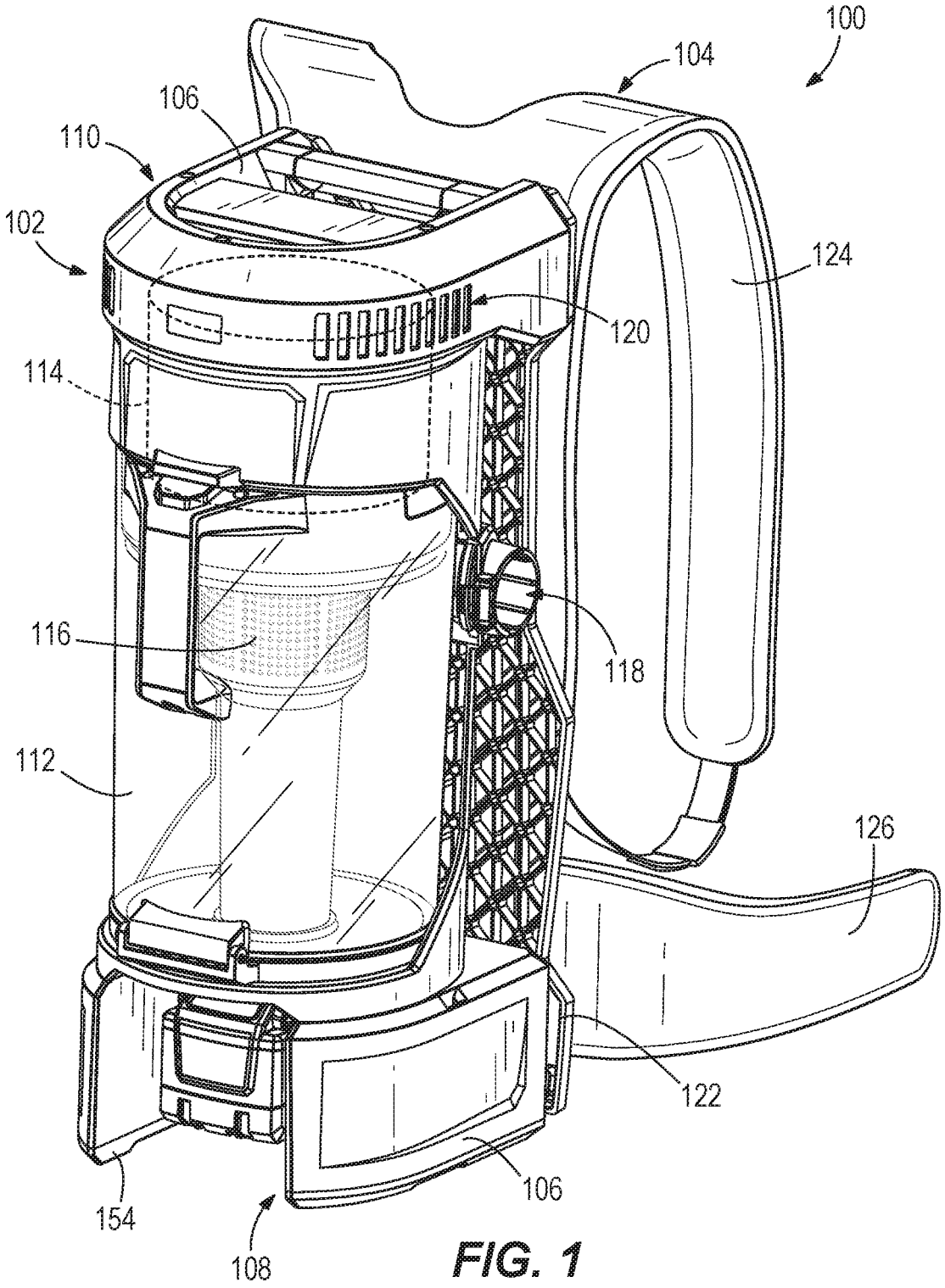
FIG. 1 is a front perspective view of a vacuum cleaner.

Turning now to FIG. 1, an embodiment of a vacuum cleaner 100 is shown. The vacuum cleaner 100 includes a vacuum body assembly 102 and a harness assembly 104. The vacuum body assembly includes a housing 106 having a base end 108 and a top end 110 opposite the base end. A debris container 112 is removably coupled to the housing 106. A suction source 114 may be disposed on or in the housing 106. The suction source 114 is configured to draw air into the debris container 112. In some embodiments, a filter element (or screen) 116 may be positioned to prevent debris from exiting the debris container 112. The vacuum body assembly 102 further includes a debris and air intake port 118 in fluid communication with the debris container 112. The vacuum body assembly 102 also includes one or more air exhaust openings 120 to exhaust air from the suction source 114.

Figure 2:
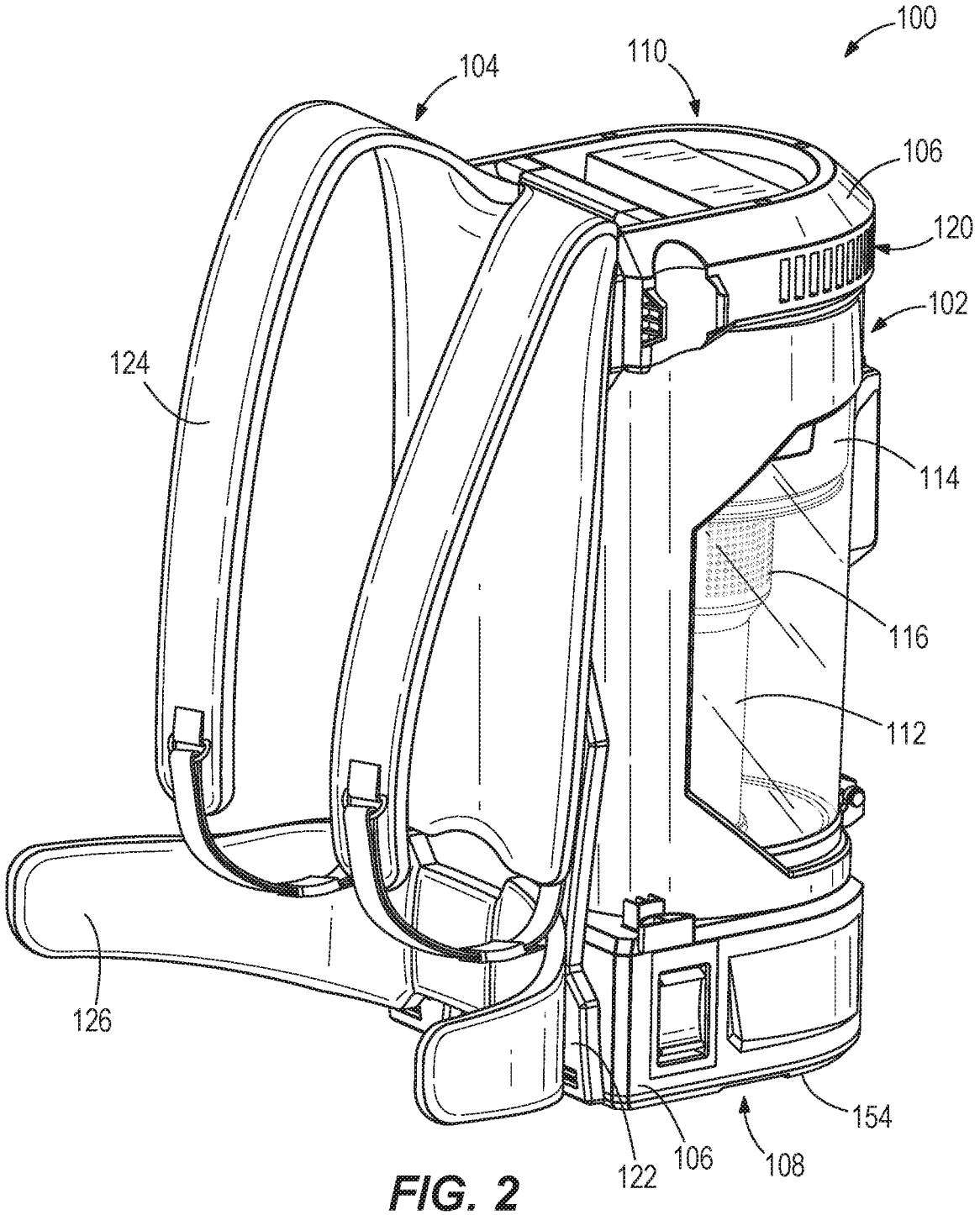
FIG. 2 is a rear perspective view of the vacuum cleaner of FIG. 1.
Figure 6:
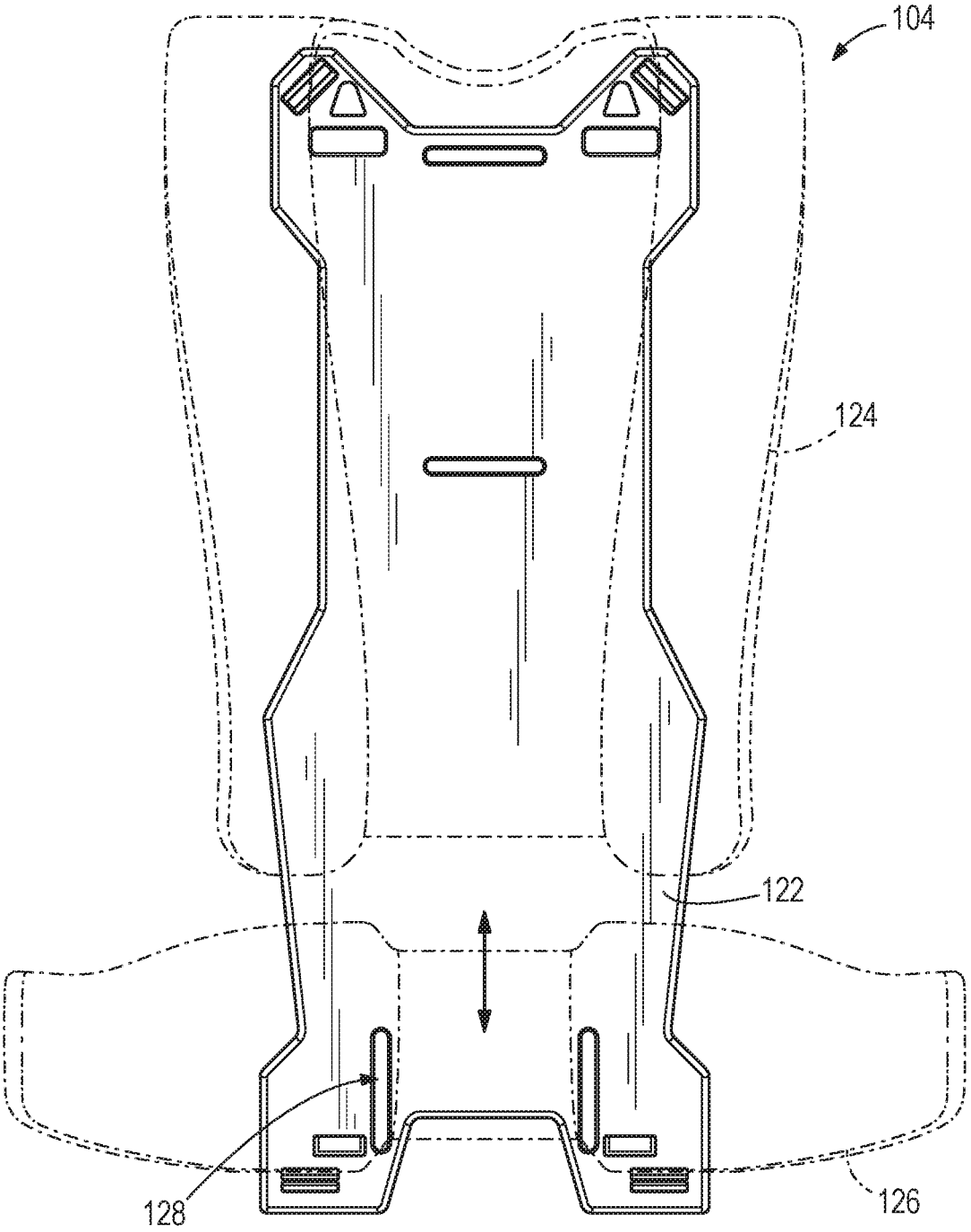
FIG. 6 is a rear elevation view of the base plate of the harness assembly of FIG. 1.
Figure 7:
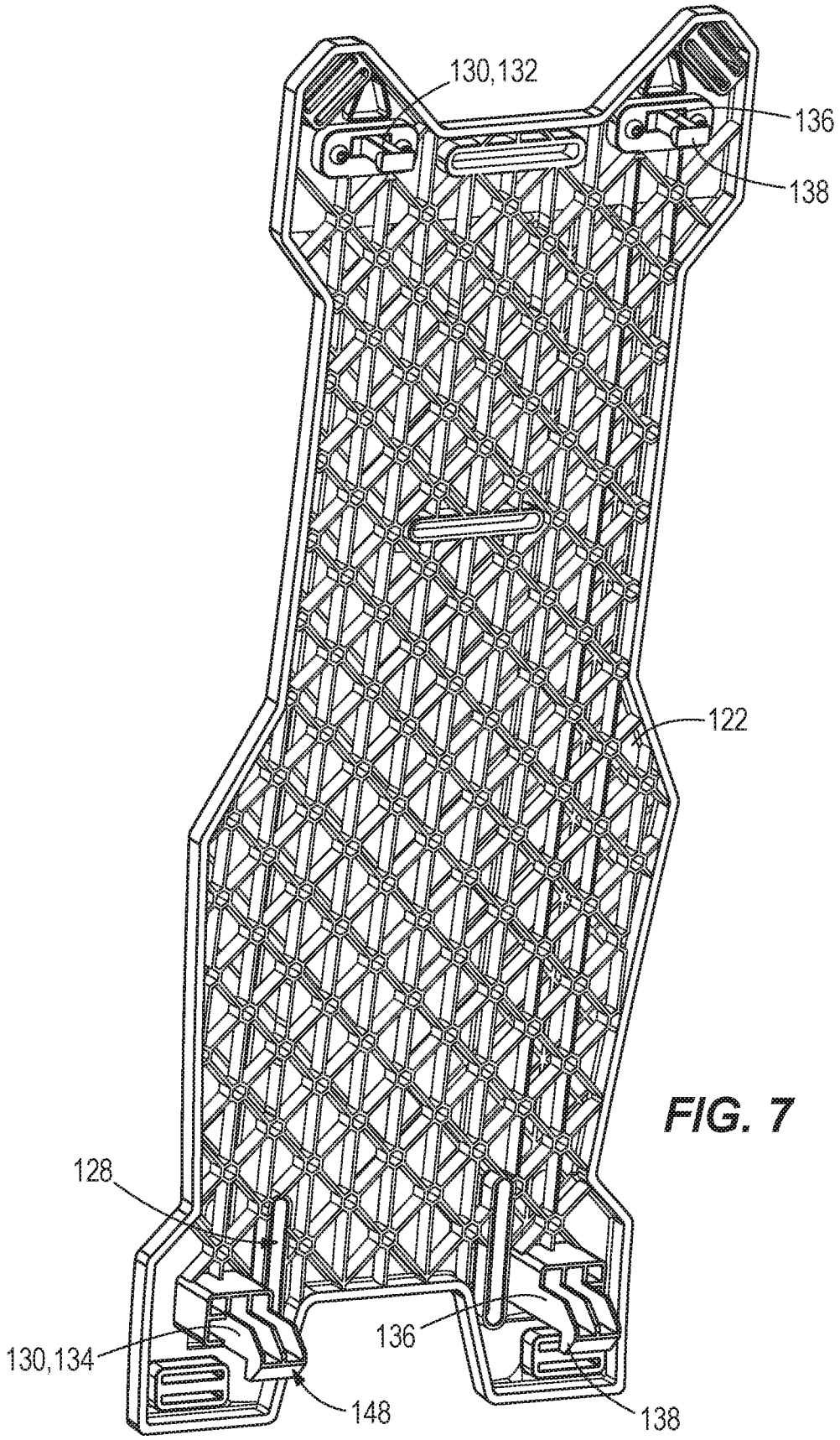
FIG. 7 is a front perspective view of the base plate of the harness assembly of FIG. 1.
Figure 8:
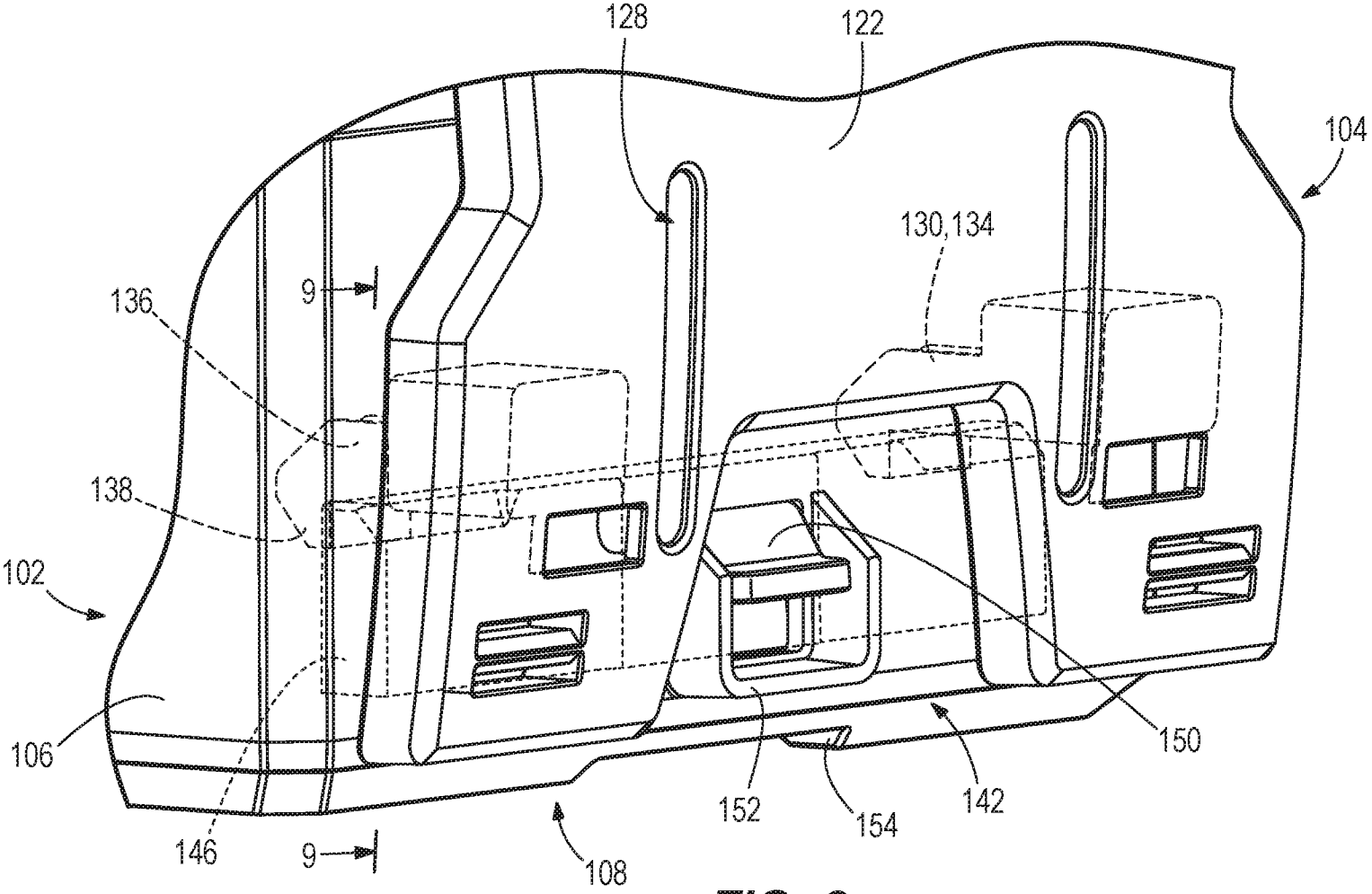
FIG. 8 is a detailed rear perspective view of a bottom portion of the vacuum body assembly of FIG. 1.

The harness assembly 104 is removably connected to the vacuum body assembly 102. The harness assembly 104 includes a base plate 122. At least one shoulder strap 124 is connected to the base plate 122. As shown best in FIG. 2, the shoulder straps may be adjustable to fit a particular user. The harness assembly 104 may further include a waist strap 126. As shown in FIG. 6, the waist strap 126 may connect to the base plate 122 at one or more vertical slots 128 to allow for vertical adjustability of the waist strap to fit a particular user.

Figure 3:
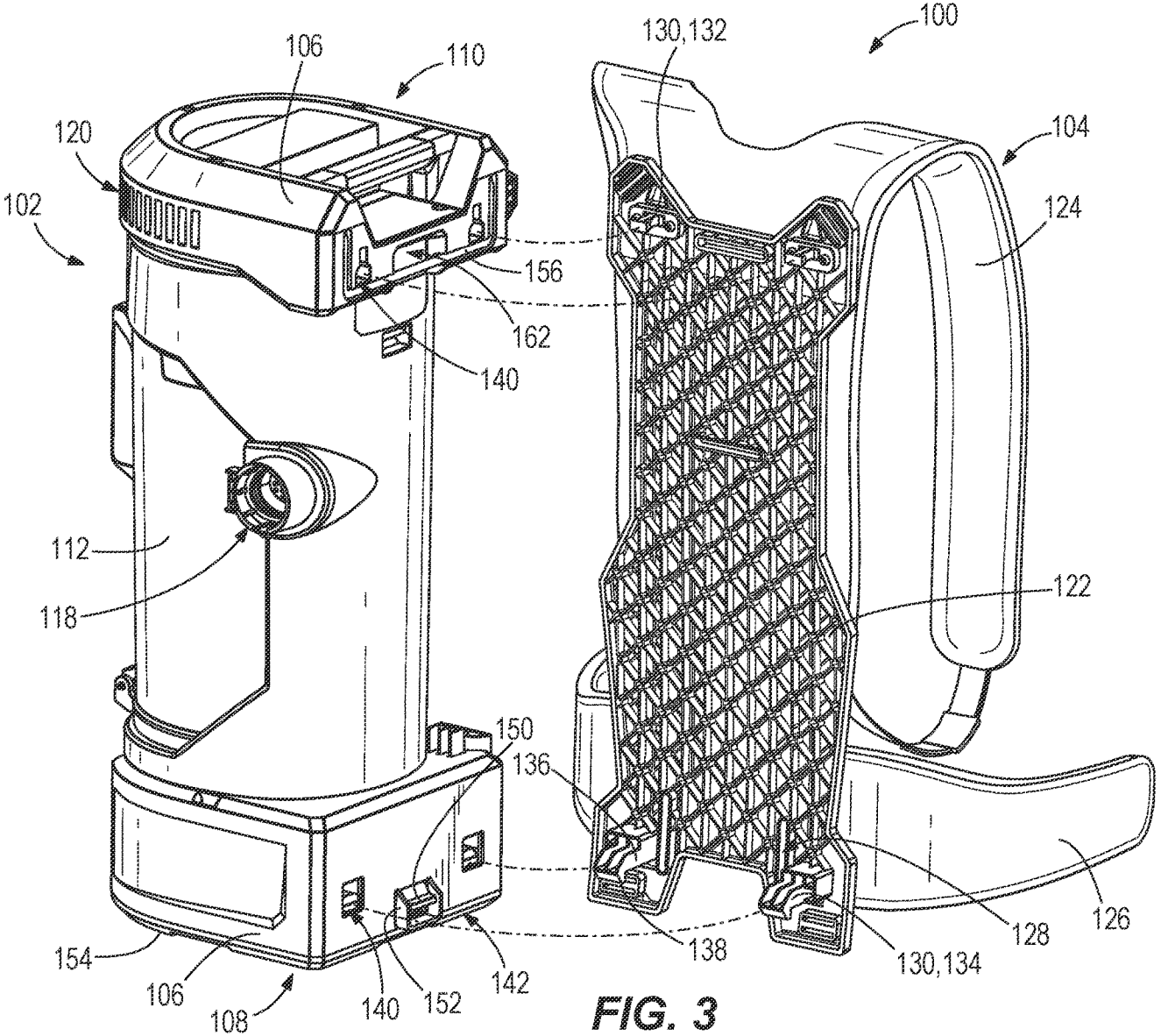
FIG. 3 is an exploded perspective view of the vacuum cleaner of FIG. 1 showing the harness assembly removed from the vacuum body assembly.

With particular reference to FIG. 3, the harness assembly 104 further includes a fastener 130 rigidly connected to the base plate 122. With regard to the illustrated embodiment, the harness assembly 104 includes four fasteners 130. The fasteners 130 may be identical to each other, or they may be different from each other. In the illustrated embodiment, the upper fasteners 132 are different from the lower fasteners 134. Both the upper fasteners 132 and the lower fasteners 134 each include a shaft section 136 and a lock section 138. In the illustrated embodiment, the upper fasteners 132 show one example of a lock section 138, which is a bar forming a T-shaped fastener with the shaft section 136. The lower fasteners 134 show another example of a lock section 138, which is a fastener hook.

Also shown in FIG. 3, the vacuum body assembly 102 includes openings 140 defined in the housing 106. The number of openings 140 corresponds to the number of fasteners 130 on the base plate 122. The openings 140 may all be the same, or they may be different from each other. In the illustrated embodiment, the openings 140 corresponding to the upper fasteners 132 are slots arranged to trap the upper fasteners once the base plate 122 translates relative to the vacuum body assembly 102. The openings 140 corresponding to the lower fasteners 134 are standard openings allowing for direct insertion of the fastener hook of each respective lower fastener.

Figure 9:
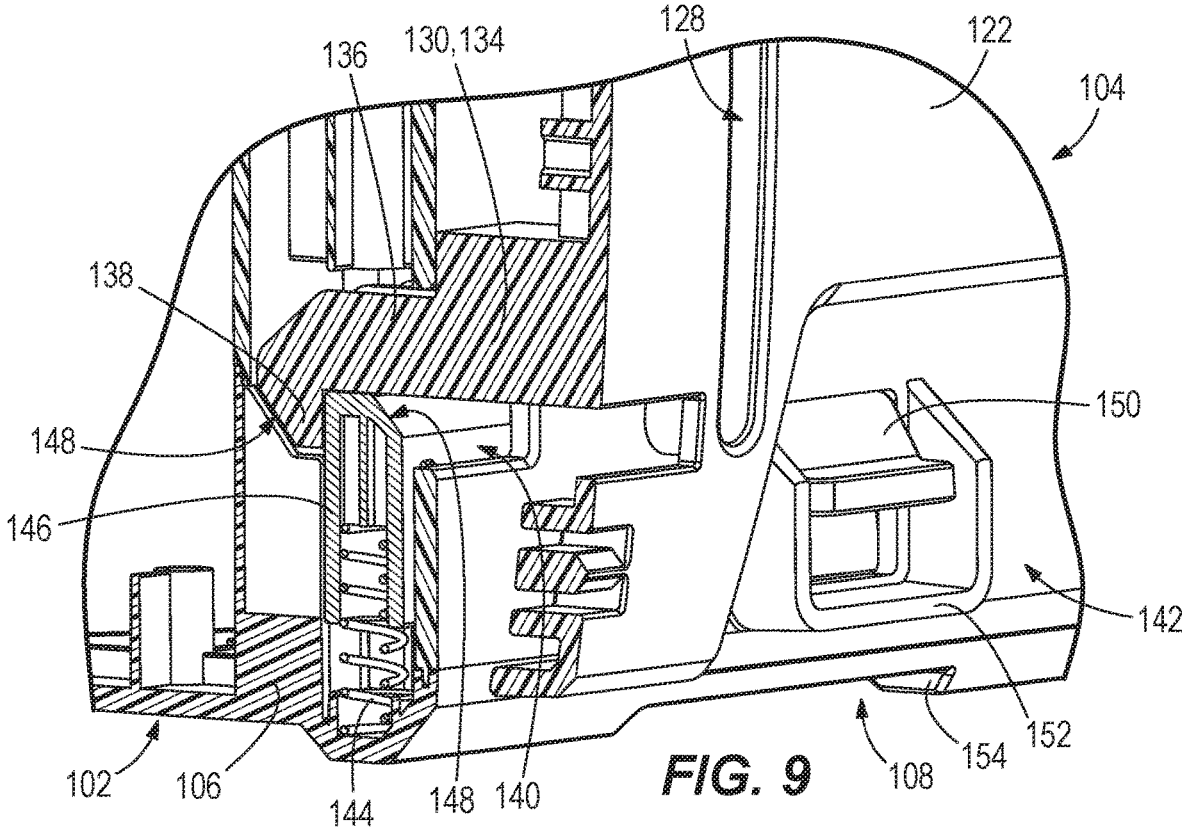
FIG. 9 is a detailed cross-sectional perspective view of the bottom portion of the vacuum body of FIG. 1 with the lock mechanism in the lock position.
Figure 10:
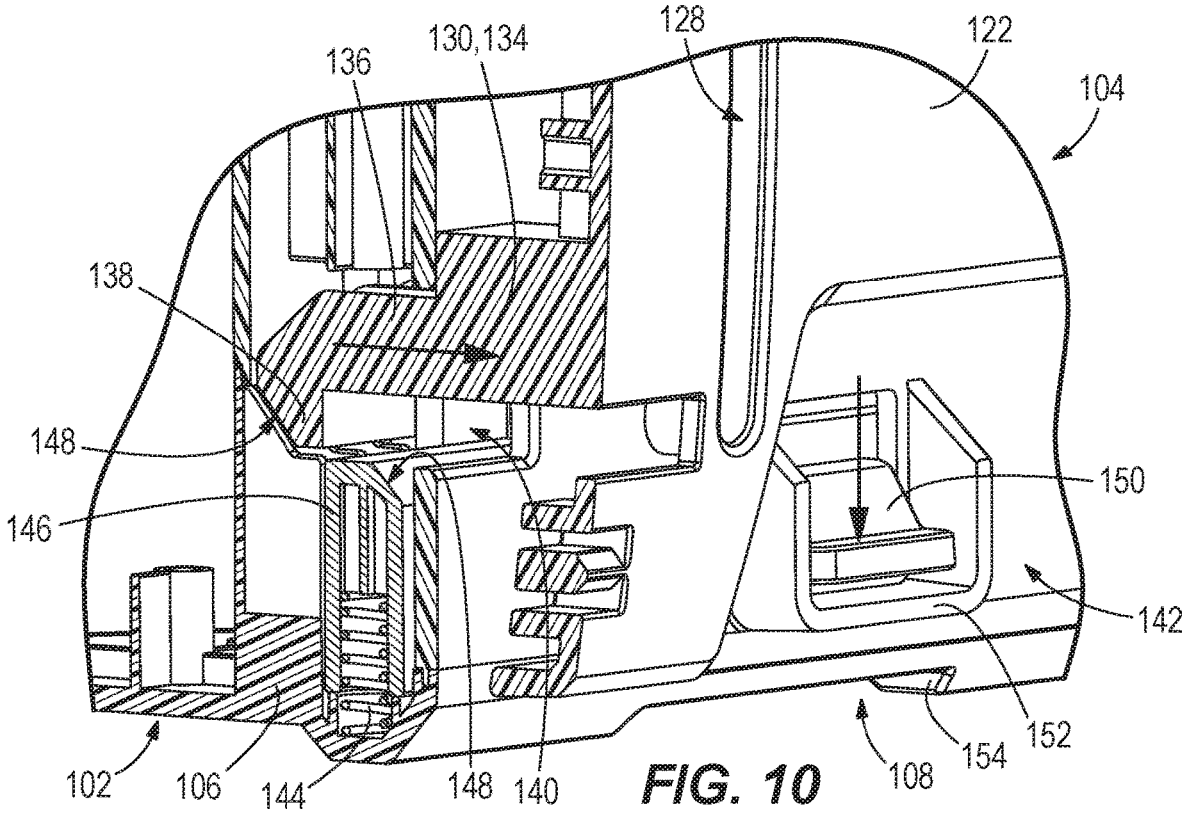
FIG. 10 is a detailed cross-sectional perspective view of the bottom portion of the vacuum body of FIG. 1 with the lock mechanism in the unlock position.

Shown best in FIGS. 9 and 10, the fastener hook of each lower fastener 134 is received through the corresponding opening 140 in the housing 106. A lock mechanism 142 movably connected to the vacuum body assembly 102 releasably locks the vacuum body assembly to the harness assembly 104 by trapping the lock section 138 of each respective lower fastener 134. In the illustrated embodiment, the lock mechanism 142 translates relative to the rest of the vacuum body assembly 102 from a lock position to an unlock position (and vice versa). The lock mechanism 142 is biased toward the lock position by one or more resilient members 144 (such as a spring). In the illustrated embodiment, the lock mechanism 142 includes a lock rail 146 that engages the fastener hook lock section 138 of the lower fasteners 134. At least one of the fastener hook lock section 138 of the lower fastener 134 and the lock rail 146 may include a chamfer 148 to allow forced connection of the vacuum body assembly 102 to the harness assembly 104 without separately actuating the lock mechanism 142. Stated another way, this one or more chamfers 148 may allow a user to "crash in" the lock section 138 into engagement with the lock rail 146 of the lock mechanism 142. In the illustrated embodiment, both the fastener hook lock section 138 and the lock rail 146 include complementary chamfers 148. Additionally or alternatively, the lock mechanism 142 includes a user engagement portion 150. The user engagement portion 150 of the lock mechanism 142 allows a user to actuate the lock mechanism to move the lock mechanism from the lock position to the unlock position. In the illustrated embodiment, the housing 106 includes a wall 152 adjacent the user engagement portion 150. The wall 152 may prevent inadvertent engagement of the user engagement portion 150. The wall 152 may also aid in allowing a user to purposely engage the user engagement portion 150. In the illustrated embodiment, the user engagement portion 150 is a lever sized and shaped to be engaged by a user's thumb or one or more fingers, and the wall 152 may be positioned such that the user may squeeze against the wall and the user engagement portion to actuate the lock mechanism from the lock position to the unlock position.

As such, the harness assembly 104 may be completely removable from the vacuum body assembly 102. The harness assembly 104 may be connected to the vacuum body assembly 102 and used to wear the vacuum cleaner 100 on the user's back in a carry mode. The harness assembly 104 need not be, but may be, removed from the vacuum body assembly 102 in order to utilize the vacuum cleaner 100 in a stand mode.

Returning to FIG. 1, the base end 108 of the housing 106 of the vacuum body assembly 102 is configured to rest on a support surface (such as the floor) in the stand mode. The base end 108 may include at least one foot 154 to engage the support surface when the vacuum cleaner 100 is in the stand mode. In the illustrated embodiment, the base end 108 includes a plurality of feet 154. Alternatively, the base end 108 may have a flat surface, or the base end may have a concave surface.

Not only may the vacuum cleaner 100 convertible between the carry mode and the stand mode, the vacuum cleaner may also be convertible to a hang mode. The conversion of the vacuum cleaner 100 into the hang mode and the utilization of the vacuum cleaner in the hang mode will be described further below.

Figure 4:
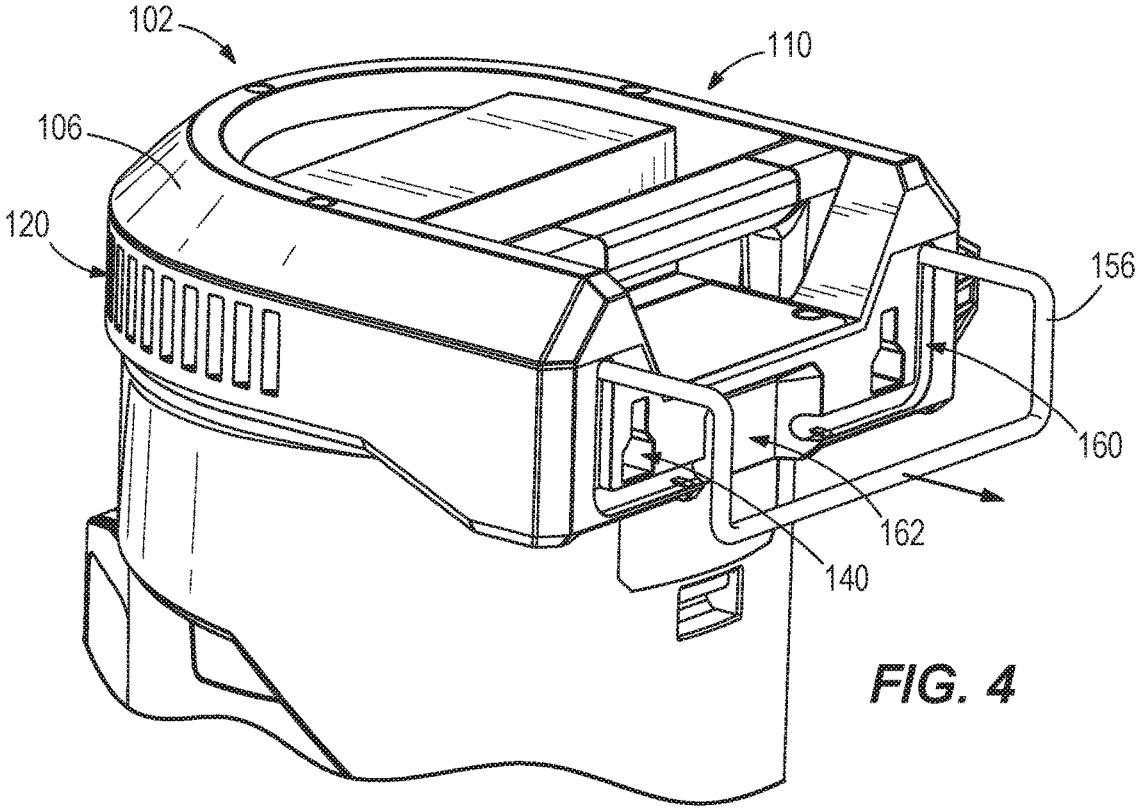
FIG. 4 is a detailed rear perspective view of a top portion of the vacuum body assembly of FIG. 1.
Figure 5:
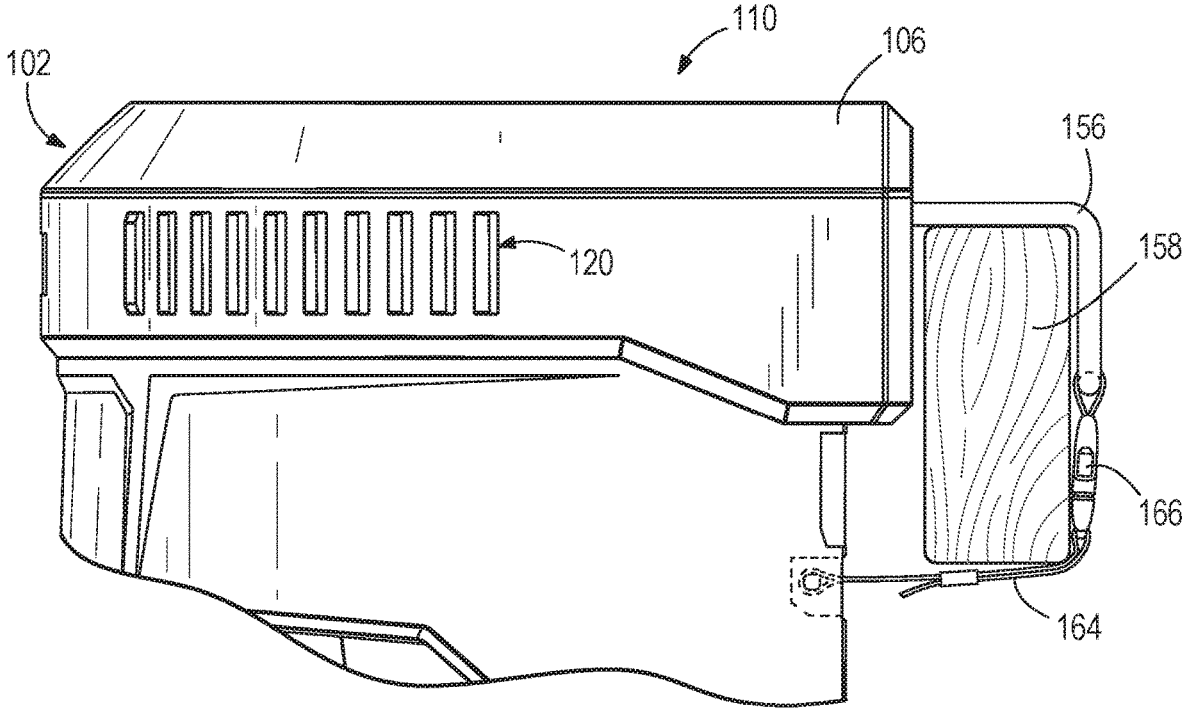
FIG. 5 is a detailed side elevation view of the top portion of the vacuum body assembly of FIG. 1.

As shown best in FIG. 4, a mount hook 156 is connected to the housing 106 of the vacuum body assembly 102. As shown in FIG. 5, the mount hook 156 allows the user to hang the vacuum body assembly 102 of the vacuum cleaner 100 from a structure 158 (such as a beam, wall, fence, etc.) in the hang mode. In the illustrated embodiment, the mount hook 156 is movable relative to the housing 106 from a collapsed position (FIG. 3) to a deployed position (FIG. 4). The mount hook 156 is in the deployed position in the hang mode and in the collapsed position in the carry mode. As shown in FIG. 4, the mount hook 156 moves translationally relative to the housing 106 to switch modes. Other embodiments may include rotating the mount hook 156 relative to the housing 106 or both rotating and translating the mount hook relative to the housing to switch modes.

Shown particularly in FIG. 3 of the illustrated embodiment, a majority of the mount hook 156 is received within the housing 106 when the mount hook is in the collapsed position. The vacuum body assembly 102 may include a recess 160 defined in the housing 106 (shown best in FIG. 4). The recess 160 is sized and shaped such that a majority of the mount hook 156 is received therein when the mount hook is in the collapsed position (FIG. 3). In fact, some embodiments may include the mount hook 156 being flush or recessed relative to the corresponding surface of the housing 106 when the mount hook is in the collapsed position. In the illustrated embodiment, the housing 106 includes a cut-out 162 which allows a user to more easily access the mount hook 156 when the mount hook is in the collapsed position. A user need only grab the mount hook 156 in the vicinity of the cut-out 162 and pull the mount hook outward from the housing 106 toward the deployed position. Other embodiments may additionally or alternatively include a detent mechanism or other mechanism that allows a user to quickly and easily move the mount hook 156 from one position to the other.

Also shown in FIG. 3, the mount hook 156 may be positioned on the housing 106 such that the mount hook is between the vacuum body assembly 102 and the harness assembly 104 when the harness assembly is connected to the vacuum body assembly. The mount hook 156 may be at least partially concealed by the harness assembly 104, and removing the harness assembly from the vacuum body assembly 102 at least partially reveals the mount hook. In the illustrated embodiment, the harness assembly 104 completely conceals the mount hook 156 when the harness assembly is connected to the vacuum body assembly 102 (see FIG. 2). In such an embodiment, the mount hook 156 is only movable from the collapsed position to the deployed position when the harness assembly 104 is not connected to the vacuum body assembly 102. Stated another way, the harness assembly 104 must be removed from the vacuum body assembly 102 to utilize the mount hook 156. As such, the harness assembly 104 is not connected to the vacuum body assembly 102 when the vacuum cleaner 100 is in the hang mode.

Turning again to FIG. 5, the vacuum body assembly 102 may further include a leash 164. The leash 164 may be connected to the housing 106 and the mount hook 156. The leash 164 may be removably connected at one or both ends, or the leash may include a connector 166 at some point between the ends of the leash. The leash 164 may be configured to releasably close a loop together with the mount hook 156. Such a configuration may allow for more stable mounting of the vacuum cleaner 100 when the vacuum cleaner is in the hang mode. The leash 164 and the mount hook 156 trap the structure 158 such that removal from the structure accidentally is far less likely.

Figure 11:
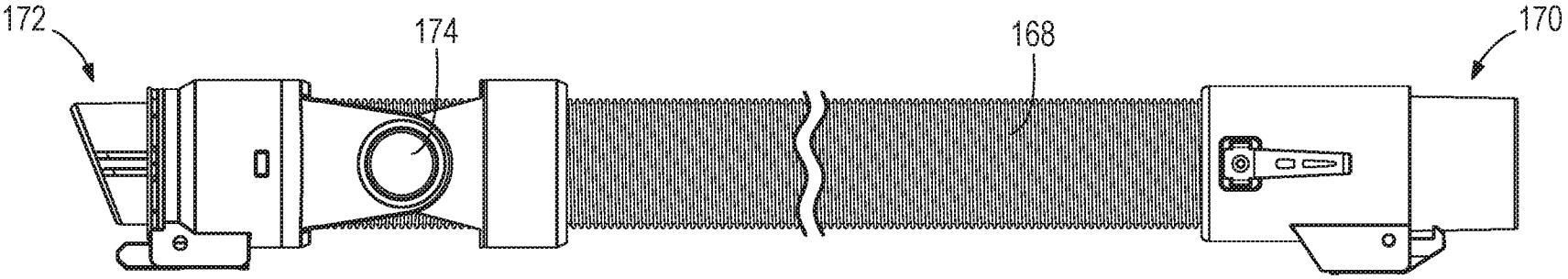
FIG. 11 is a side elevation view of a suction hose adapted for use with the vacuum cleaner of FIG. 1.
Figure 12:
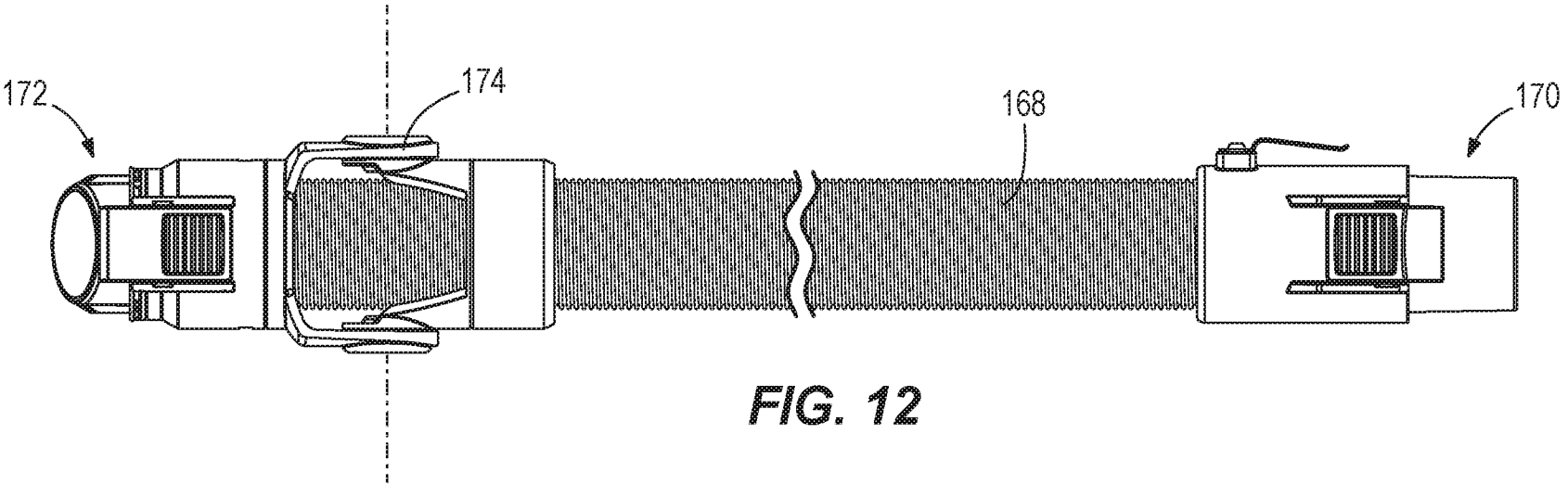
FIG. 12 is a top plan view of the suction hose of FIG. 11.

With reference to FIGS. 11 and 12, the vacuum body assembly 102 further includes a suction hose 168. The suction hose 168 has an accessory end 170 and an attachment end 172. The accessory end 170, in the illustrated embodiment, is configured to accept one or more interchangeable accessory nozzles. The attachment end 172 is configured to removably attach the suction hose 168 to the vacuum body assembly 102. In particular, the attachment end 172 is connected to the vacuum body assembly 102 at the debris and air intake port 118. In the illustrated embodiment, the suction hose 168 includes a pivot joint assembly 174. The pivot joint assembly 174 allows a user to pivot the majority of the suction hose 168 relative to the vacuum body assembly 102. As such, a user may angle the suction hose 168 downward relative to the vacuum body assembly 102 when the vacuum cleaner 100 is in the carry mode. Likewise, a user may angle the suction hose 168 upward relative to the vacuum body assembly 102 when the vacuum cleaner 100 is in the stand mode.

Figure 13:
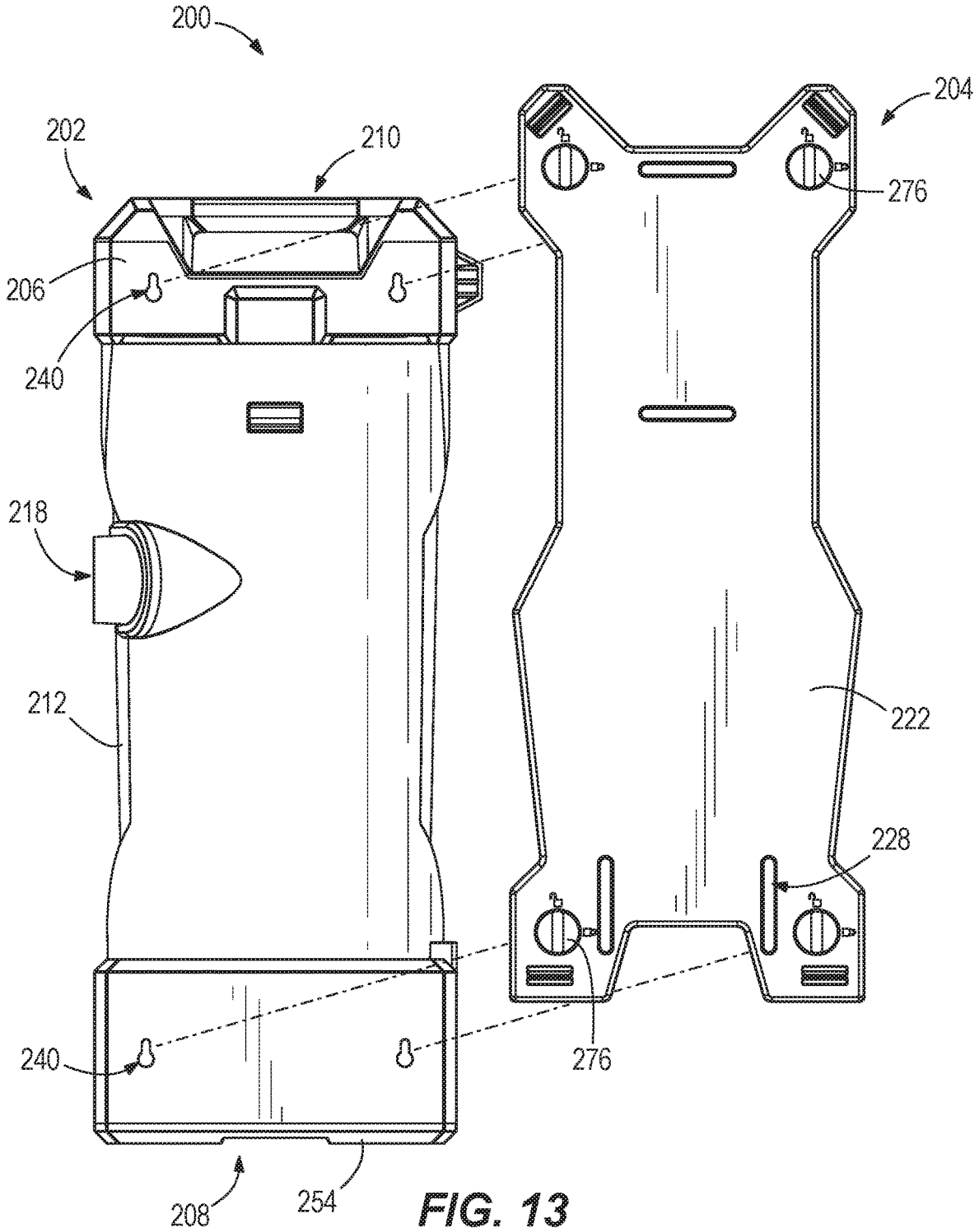
FIG. 13 is an exploded rear elevation view of a vacuum cleaner with a base plate of a harness assembly removed from a vacuum body assembly.

Referring now to FIG. 13, an alternative embodiment of a vacuum cleaner 200 is shown. In particular, the vacuum cleaner 200 has a different connection between the vacuum body assembly 202 and the base plate 222 of the harness assembly 204. The fasteners (not shown) are rotatable relative to the base plate 222. The fasteners are connected to quarter-turn actuators 276. As such, the vacuum body assembly 202 includes openings 240 in the housing 206 shaped to allow lateral passage of the fasteners in and out of the openings when the quarter-turn actuators 276 are in the unlocked position (as shown in FIG. 13). The fasteners are blocked by the shape of the openings 240 in the housing 206 when the quarter-turn actuators 276 are turned to the locked position, thereby securing the base plate 222 to the vacuum body assembly 202 in the carry mode.

Various other possibilities are contemplated in this disclosure. Any feature of one embodiment may be combined or substituted for another feature in another embodiment to form still another embodiment. The discussion in this disclosure should not be viewed as limiting, and instead should be viewed as an explanation of exemplary embodiments among many possible embodiments.

Various features and advantages of the disclosure are set forth in the following claims.

What is claimed is:

1. A vacuum cleaner comprising:

a vacuum body assembly including a housing having a base end, a top end opposite the base end, and a longitudinal direction extending through the base end and the top end;

a mount hook connected to the housing, the mount hook movable translationally relative to the housing in a direction transverse to the longitudinal direction of the housing, the mount hook movable from a collapsed position to a deployed position;

a debris container removably coupled to the housing; and a handle separate from the mount hook, wherein the handle is located at the top end;

a suction source configured to draw air into the debris container;

a harness assembly removably connected to the vacuum body assembly; and wherein the vacuum cleaner is convertible between a carry mode, the harness assembly connected to the vacuum body assembly in the carry mode, the harness assembly configured to be worn by a user, the mount hook in the collapsed position in the carry mode;

a stand mode, the base end of the vacuum body assembly configured to rest on a support surface in the stand mode, the top end located above the base end in the stand mode; and a hang mode, the mount hook of the vacuum body assembly in the deployed position and configured to hang the vacuum body assembly from a mount structure in the hang mode, the top end located above the base end in the hang mode.

2. The vacuum cleaner of claim 1, the harness assembly further including a base plate removably connected to the vacuum body assembly; and at least one shoulder strap connected to the base plate.

3. The vacuum cleaner of claim 2, wherein the harness assembly is not connected to the vacuum body assembly in the hang mode.

4. The vacuum cleaner of claim 1, wherein a majority of the mount hook is received within the housing when the mount hook is in the collapsed position.

5. The vacuum cleaner of claim 1, wherein the vacuum body assembly further includes a leash configured to releasably close a loop together with the mount hook.

6. The vacuum cleaner of claim 1, wherein the base end of the vacuum body assembly includes at least one foot configured to engage the support surface in the stand mode.

7. The vacuum cleaner of claim 1, wherein the vacuum cleaner is operable to draw air into the debris container via the suction source in the stand mode, and wherein the vacuum cleaner is operable to draw air into the debris container via the suction source in the carry mode.

8. A vacuum cleaner comprising:

a vacuum body assembly including a housing including an opening defined therein;

a mount hook connected to the housing, the mount hook at least partially surrounding the opening, the mount hook movable translationally relative to the vacuum body assembly from a collapsed position to a deployed position, the mount hook configured to hang the vacuum body assembly from a mount structure;

a debris container removably coupled to the housing; and a suction source configured to draw air into the debris container;

a harness assembly removably connected to the vacuum body assembly, the harness assembly including a fastener removably received in the opening; and wherein with the fastener of the harness assembly received in the opening of the housing, the mount hook is trapped between the housing of the vacuum body assembly and the harness assembly such that the mount hook is at least partially concealed by the harness assembly; and removing the harness assembly from the vacuum body assembly at least partially reveals the mount hook.

9. The vacuum cleaner of claim 8, wherein the vacuum body assembly includes a recess; and a majority of the mount hook is received in the recess in the collapsed position.

10. The vacuum cleaner of claim 8, wherein the mount hook is only movable from the collapsed position to the deployed position when the harness assembly is not connected to the vacuum body assembly.

11. The vacuum cleaner of claim 8, wherein the harness assembly must be removed from the vacuum body assembly to utilize the mount hook.

12. A vacuum cleaner comprising:

a vacuum body assembly including a housing;

a bagless debris container removably coupled to the housing; and an electrically-powered suction source configured to draw air into the bagless debris container;

a harness assembly removably connected to the vacuum body assembly, the harness assembly including a base plate;

at least one shoulder strap connected to the base plate; and at least two fasteners rigidly connected to the base plate, each fastener having a shaft section and a lock section;

a lock mechanism movably connected to the housing of the vacuum body assembly to releasably lock the vacuum body assembly to the harness assembly, the lock mechanism actuatable from a lock position to an unlock position, the lock mechanism including a single lock rail; and wherein the lock rail traps the lock section of each of the at least two fasteners in the lock position.

13. The vacuum cleaner of claim 12, wherein the lock section of the fastener includes a fastener hook.

14. The vacuum cleaner of claim 13, wherein the lock rail engages the fastener hook.

15. The vacuum cleaner of claim 14, wherein at least one of the fastener hook and the lock rail includes a chamfer to allow forced connection of the vacuum body assembly to the harness assembly without separately actuating the lock mechanism.

16. The vacuum cleaner of claim 12, wherein the lock mechanism is biased toward the lock position.

17. The vacuum cleaner of claim 12, wherein the lock mechanism includes a user engagement portion configured to be actuated by a user to move the lock mechanism from the lock position to the unlock position.

* * * * *